US007217390B2

(12) United States Patent
Shim et al.

(10) Patent No.: US 7,217,390 B2
(45) Date of Patent: May 15, 2007

(54) METHOD OF FABRICATING ULTRA-FINE CERMET ALLOYS WITH HOMOGENEOUS SOLID GRAIN STRUCTURE

(75) Inventors: Jae Hyeok Shim, Seoul (KR); Jong Ku Park, Gyeonggi-do (KR); Young Whan Cho, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 482 days.

(21) Appl. No.: 10/681,009

(22) Filed: Oct. 8, 2003

(65) Prior Publication Data

US 2005/0047950 A1 Mar. 3, 2005

(30) Foreign Application Priority Data

Aug. 26, 2003 (KR) ..... 10-2003-0058941

(51) Int. Cl.
*B22F 1/00* (2006.01)

(52) U.S. Cl. ..... 419/38; 419/39

(58) Field of Classification Search ..... 419/38
See application file for complete search history.

(56) References Cited

U.S. PATENT DOCUMENTS 3,785,801 A * 1/1974 Benjamin ..... 75/255
4,013,460 A * 3/1977 Brown et al. ..... 419/15
4,070,184 A * 1/1978 Scheithauer et al. ..... 419/18
4,231,762 A * 11/1980 Hara et al. ..... 51/309
4,830,930 A * 5/1989 Taniguchi et al. ..... 428/547
5,322,666 A * 6/1994 Watwe ..... 419/32
5,563,107 A * 10/1996 Dubensky et al. ..... 501/87

* cited by examiner

*Primary Examiner*—Roy King
*Assistant Examiner*—Nicholas A. Smith
(74) *Attorney, Agent, or Firm*—Harness, Dickey & Pierce, PLC

(57) ABSTRACT

The present invention relates to a method of fabricating ultra-fine grain cermet alloys with a homogenous solid solution grain structure. More particularly, the invention relates to a method of fabricating an ultra-fine TiC-base cermet alloy with a homogenous solid solution structure which does not comprise a core-rim structure in the carbide grain.

The object of the present invention is to provide a method of fabricating a TiC-base cermet alloy without the core-rim structure.

The above objects of the present invention could be achieved by employing a conventional sintering process (vacuum sintering) of (Ti,TM)C carbide obtained from a mechano-chemical synthesis (high energy ball-milling) from milling the powders of Ti, TM, Ni and Co metals.

14 Claims, 4 Drawing Sheets

METHOD OF FABRICATING ULTRA-FINE CERMET ALLOYS WITH HOMOGENEOUS SOLID GRAIN STRUCTURE

BACKGROUND OF THE INVENTION

The present invention relates to a method of fabricating ultra-fine cermet alloys with a homogenous solid solution grain structure. More particularly, the invention relates to a method of fabricating an ultra-fine TiC-base cermet alloy with a homogenous solid solution grain structure that does not comprise a core-rim structure in the carbide grain.

In general, the ultra-fine TiC-base cermet alloys are used as cutting tools for the finishing works of steel and cast iron due to their high hardness and abrasion resistance characteristics.

The sintered body of a TiC-base cermet alloy comprises a distinctive dual structure in its carbide grains. This dual structure which is known as the core-rim structure comprises a center region (core) in which the main component includes TiC or TiCN, and a outer (peripheral) second region (rim) which surrounds the core and is mainly a carbide of solid solution such as (Ti, TM)C or (Ti, TM) (C, N), (See, FIG. 8: In reference to Hans-Olof Andrn, "Microstructures of cemented carbides," Materials and Design, 22, pp491–498 (2002)).

The rim region surrounding the core is also known to form an end-product in the type of solid solution that precipitates on the surface of TiC or TiCN grains as a result of grain growth process in a Ni-rich liquid during liquid phase sintering process (In reference to T. Yamamoto, A. Jaroenworaluck, Y. Ikuhara and T. Sakuma, "Nano-probe analysis of core-rim structure of carbides in TiC-20 wt % $Mo_2C$-20 wt % Ni cermet, "Journal of Materials Research, 14, (1999), pp4129–4131).

The reason for this formation is not contributed to thermodynamically equilibrium structure but more to a kinetic reason (In reference to J. H. shim, C. S. Oh and D. N. Lee, "A thermodynamic evaluation of the Ti—Mo—C system," Metallurgical and Materials Transaction B, 27B, (1996), pp955–996).

TiC-base cermet alloy with the previously mentioned core-rim structure is not representing the physical property of carbides of uniform grain structure that composition allows but showing the physical property that originates from the dual structure of carbide grains. This also has some drawbacks of deteriorating the physical property of the sintering body.

Accordingly, in perspective of the composition, the cermet with a uniform microstructure could represent a different physical property with respect to that of the existing cermet.

To date, however, no fabrication method of TiC-base cermet alloys with the core-rim structure were able to overcome the limit of kinectic determination.

One of the big emerging technologies in the area of cutting tool material development is improving the hardness and toughness of cutting materials by reducing the size of carbide grains from a few micrometers to several submicrometers.

The fabrication methods of ultra-fine grain cutting tool materials which are known to date all involves sintering of carbides powder with a diameter less than 100 nm (nanometer) that is fabricated through a gas phase or solid state reaction.

However, the gas phase or solid state reaction method is inappropriate for massive manufacturing of carbide nano-powders, because the carbide nano-powders obtained from such methods could easily be oxidized when exposed to the atmosphere.

SUMMARY OF THE INVENTION

The present invention is designed to overcome the above problems of prior art. The object of the present invention is to provide a method of fabricating a TiC-base cermet alloy without the core-rim structure.

Another object of the present invention is to provide a high hardness TiC-base cermet alloy with ultra-fine grains which has a uniform microstructure in the alloy.

The above objects of the present invention could be achieved by employing a conventional sintering (vacuum sintering) of (Ti,TM)C—(Co,Ni) composite powders obtained by mechano-chemical synthesis (high energy ball-milling) from milling the powders of Ti, TM, Ni and Co metals.

DETAILED DESCRIPTION OF THE EMBODIMENTS

Figure 1:
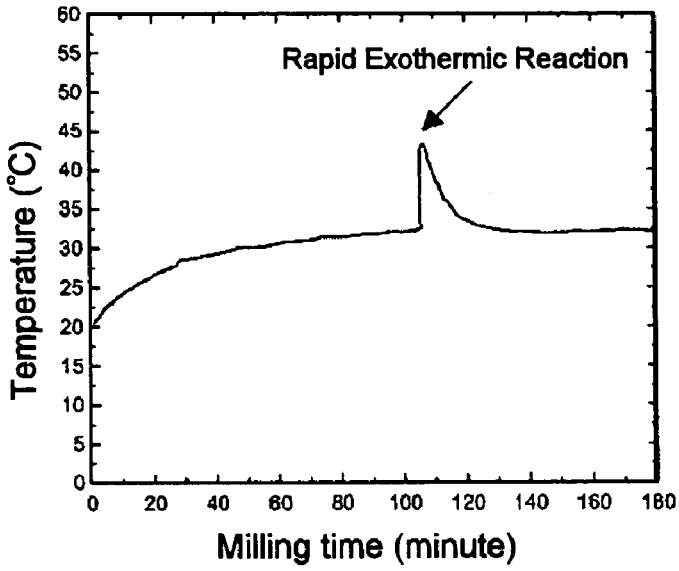
FIG. 1 represents the temperature rise on the surface of the milling jar with respect to the high energy ball milling time.

The fabrication method of a ultra-fine TiC-base cermet alloy with a homogenous solid solution grain structure according to the present invention comprises the steps of: forming powder mixture of TiC 50–90 wt % (weight percentage), TMxCy (where x and y are integers) 5–30 wt % and Ni or Co or a mixture of Ni and Co 5–30 wt % from mixing Ti powder, transition metal (TM) powder, carbon powder, Ni powder and Co powder; forming a composite powder of (Ti, TM)C—(Ni, Co) through a high energy ball milling process after putting the powder mixture into a milling jar together with balls with a fixed diameter; and compacting and sintering the synthesized composite powder.

The Ti powder, Transition metal powder, Carbon powder, Ni powder and Co powder have a purity value above 95% and their particle size is less than 1 mm. The Transition metal is at least one metal element selected from the group consisting of Molybdenum (Mo), Tungsten (W), Niobium (Nb), Vanadium (V) and Chromium (Cr).

The basic material for the milling jar and the balls is at least one element selected from the group consisting of tool steel, stainless steel, WC—Co hard metal, silicon nitride, alumina, and Zirconia.

The diameters of the balls are in a range between 5 and 30 mm in diameter and put into the milling jar with powder mixture by the weight ratio of between 1:1 and 100:1.

The high energy ball milling process further comprises a step of measuring the surface temperature of the milling jar using a non-contact type infrared thermometer. From the onset of a sharp temperature rise on the surface of the milling jar, the ball milling process is continued for 1 to 20 hours.

The high energy ball milling process is implemented using a shaker mill, vibration mill, planetary mill, and attritor mill after charging argon gas into the milling jar.

The sintering is carried out under a $10^{-2}$ torr vacuum condition or under an argon environment in a temperature range between 1300 and 1500° C. for a duration of 1 to 4 hours.

Hereinafter, the fabrication method of an ultra-fine cermet alloy with a homogenous solid solution grain structure according to the present invention will be described in detail.

First of all, the transition metal powders such as Ti powder with a purity value above 95% and its diameter less than 1 mm, Mo powder with a purity value above 95% and its diameter less than 1 mm, W powder, Nb powder, V powder and Cr powder are mixed together to form powder mixture of TiC 50–90 wt % (weight percentage), TMxCy (where x and y are integers) 5–30 wt % and Ni or Co or a mixture of Ni and Co 5–30 wt %. In this case, the values of x and y are dependent upon the type of transition metal utilized and the type of carbides for the transition metal (TMxCy) could be more than one type.

Next, the powder mixture is put into a milling jar together with balls with diameters in a range between 5 and 30 mm. In this instance, the weight ratio between the balls and powder mixture to be put into the milling jar is in a range between 1:1 and 1:100.

The reason for constraining the weight ratio between the balls and powder mixtures to a range between 1:1 and 1:100 is to prevent pick-up of impurities caused by the wear and tear between the balls and jar when the weight ratio is set below 1:1.

For the basic material for the milling jar and the balls, at least one material is selected from the group consisting of tool steel, stainless steel, WC—Co hard metal, silicon nitride, alumina, and Zirconia.

Afterwards, the high energy ball milling process is carried out using a shaker-mill, vibration-mill, planetary-mill and attritor-mill after charging argon gas into the milling jar.

Here, the reason for charging argon gas into the milling jar is to prevent oxidization of the powders during the ball-milling process.

The balls used for the ball milling process could all be equal in size or in two different sizes.

During the ball milling process, the surface temperature of the milling jar is measured using a non-contact type infrared thermometer.

As shown in FIG. 1, a sharp temperature rise on the surface of the milling jar is observed. This sharp temperature rise on the surface of the milling jar is due to the heat generated from the reaction between the element powders to form (Ti, TM)C during the milling process.

Afterwards, the temperature drops gradually since the heat is dissipated to the ambient through the milling jar after the reaction is completed.

The sharp temperature rise is affected by the weight ratio between the balls and powder mixture and this is mainly observed between 1 and 2 hours after the milling started.

After the occurrence of reaction between element powders to form (Ti, TM)C phase, the ball milling process is continued for 1 to 20 hours. The reason for continuing the ball milling is to reduce the grain size of (Ti, TM)C to below 10 nm.

Finally, the composite powders synthesized through the ball milling process are dried and granulated for compaction, the compact is sintered under a 10−2 torr vacuum condition or under an argon environment. In this instance, the compact is sintered at a temperature between 1300 and 1500° C. for a duration of 1 to 4 hours.

Hereinafter, preferred embodiments of the present invention will be described in detail with reference to the accompanying drawings.

[Preferred Embodiment 1]

Ti powder with a purity value above 99.7% and diameter less than 45 μm, Mo powder with a purity value above 99.7% and diameter less than 5 μm, C powder with a purity value above 99% and diameter less than 5 μm, Ni powder with a purity value above 99.7% and diameter less than 6 μm are mixed to form powder mixture of TiC 60 wt %, $Mo_2C$ 20 wt % and Ni 20 wt %.

The powder mixture is put into a tool steel milling jar together with tool steel balls with diameter of 9.5 mm where the weight ratio between the powder mixture and balls is 10:1. Next, high energy ball milling is carried out for 20 hours after the milling jar is charged with argon gas.

The surface temperature of the milling jar is measured using a non-contact type infrared thermometer.

As shown in FIG. 1, a sharp temperature rise on the surface of the milling jar is found in 100 minutes during milling.

The milled composite powders dried, granulated and compacted under a pressure of 20 MPa. The compact is sintered under a $10^{-2}$ torr vacuum condition for the duration of 1 hour.

Figure 2:
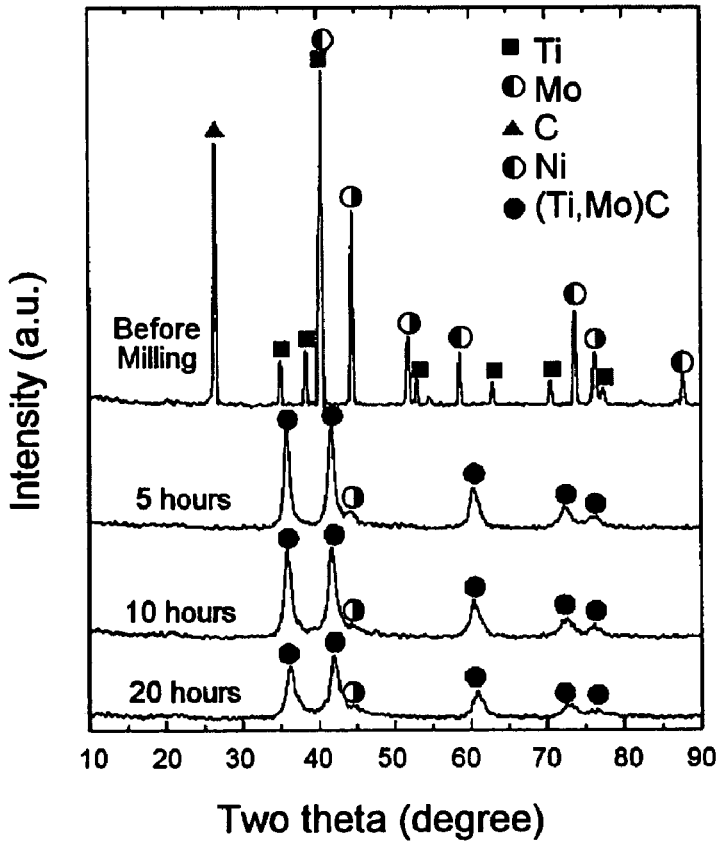
FIG. 2 represents the change in the X-ray diffraction pattern for TiC-20 wt %-Ni with respect to the high energy ball milling time.

FIG. 2 represents the change in the X-ray diffraction pattern with respect to the high energy ball milling time.

The element powders such as Ti, Mo, C, and Ni are transformed into a composite phase of (Ti, Mo)C and Ni after 5 hours of milling. No more phase change is observed as a result of further milling and the height of diffraction peak is lowered and the width is increased.

This indicates that primarily (Ti, Mo)C phase is formed during the milling and the size of the grains is then reduced due to the mechanical energy continuously applied to the grains as a result of the milling.

After 20 hours of milling, the size of (Ti, Mo)C grains, which could be estimated from the x-ray diffraction pattern, is found to be about 10 nm in diameter.

Figure 3:
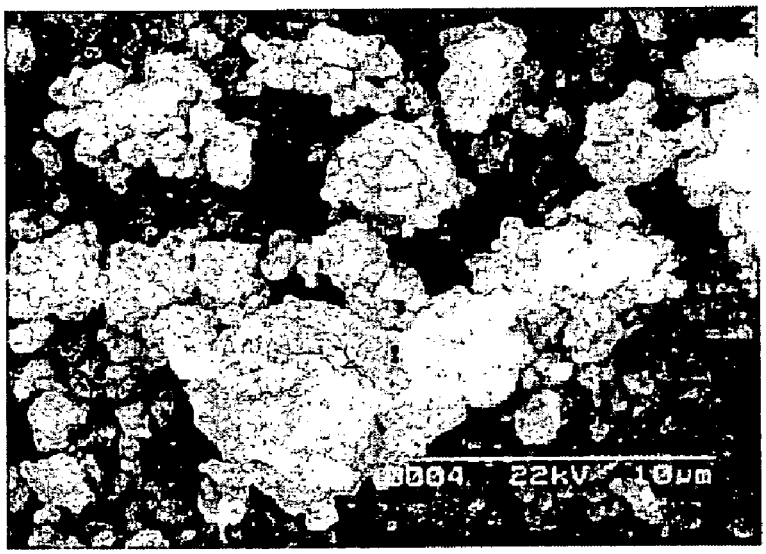
FIG. 3 shows a scanning electron microscope (SEM) picture of TiC-20 wt %-$Mo_2C$-20 wt20% powder manufactured by 20 hours milling.

FIG. 3 shows a scanning electron microscope (SEM) picture of the powder manufactured by 20 hours milling. The powder has a non-uniform shape and a size of 1 μm in diameter.

Figure 4:
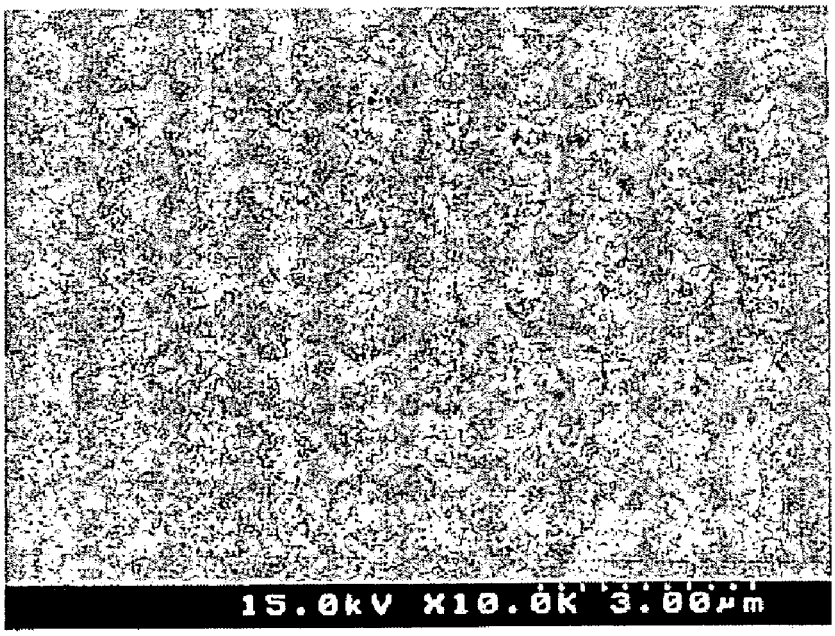
FIG. 4 shows a scanning electron microscope (SEM) picture of the microstructure of (Ti, Mo)C—Ni type cermet.

FIG. 4 shows a SEM picture of TiC-base cermet microstructure obtained by sintering the fabricated powder. The gray angular phase is (Ti, Mo)C grains and the bright region is a Ni-rich matrix (Ni-rich solid solution) which is a liquid phase at the sintering temperature.

Figure 8:
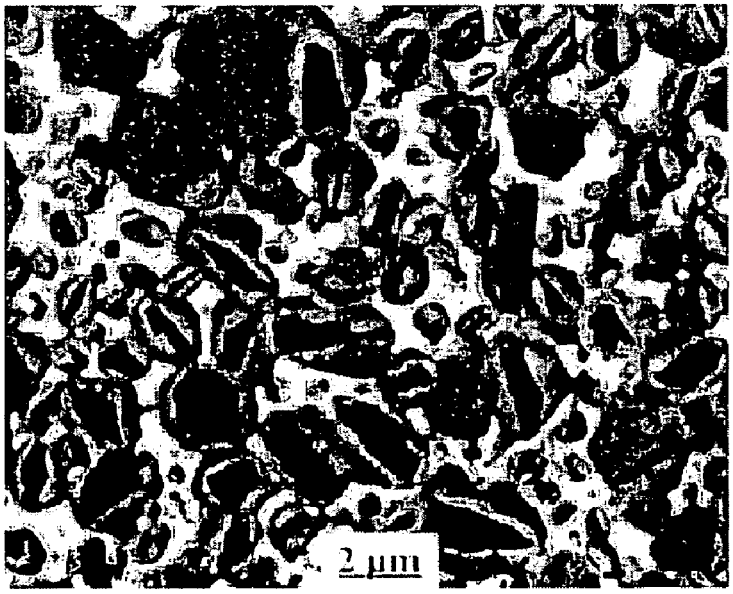
FIG. 8 shows a scanning electron microscope (SEM) picture of the microstructure of TiC—TiN—$Mo_2C$—Ni type cermet fabricated according to the prior art.

Unlike the microstructure of TiC-base cermet in FIG. 8, which were fabricated by the conventional method, the cermet fabricated according to the method in the present invention does not show the core-rim structure and the size of carbide grains is very small. The average size of carbide grains measured by image analysis method is about 0.5 μm. This is much smaller than the grain size of the conventional cermet of which grain size is in a range between 2 and 5 μm.

The hardness of the cermet fabricated according to the method in the present invention is about 92HRA. The high hardness value is probably due to the fine grain structure of cermet made by present invention. The reason that the cermet fabricated according to the method in the present invention does not have the core-rim structure is that the phase formed during the high energy ball milling process is not a mixture of TiC and $Mo_2C$ but instead a thermodynamically stable (Ti, Mo)C solid solution. The powder of (Ti, Mo)C solid solution allows to form a core-rim-free grain structure.

Figure 5:
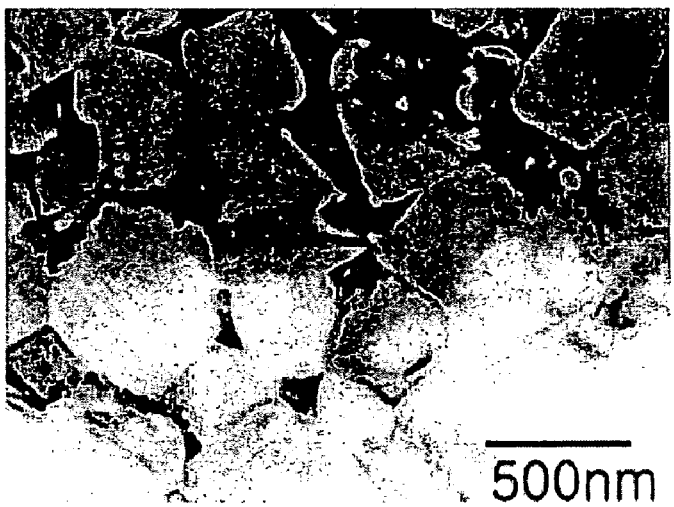
FIG. 5 shows a transmission electron microscopy (TEM) picture of the microstructure of (Ti, Mo)C—Ni type cermet.

FIG. 5 is a transmission electron microscopy (TEM) picture which shows the microstructure of TiC-base cermet fabricated according to the method in the present invention. Very fine carbide grains are observed and no structural irregularities exist in the carbide grains.

Table. 1 shows the chemical composition near the center and periphery of the carbide grains which is analyzed by a energy dispersive micro-analyzer attached to the TEM. Table. 1 shows that the concentration of Ti and Mo is consistent in the interior of whole carbide grains.

| Location in the grain | | Composition (weight %) | | | | | |
|---|---|---|---|---|---|---|---|
| Present | Prior | Present invention | | Prior art* | | | |
| invention | art | Ti | Mo | Ti | W | Mo | Ni |
| Center region | Core region | 67.1 | 32.9 | 92.8 | 4.7 | 0.4 | 2.3 |
| (Boundary region)** | Boundary region | — | — | 43.4 | 41.7 | 11.3 | 3.5 |
| Periphery region | Outer region | 68.0 | 32.0 | 32.0 | 20.2 | 7.5 | 3.2 |

*TiC(—TiCN)—WC—$Mo_2C$—Ni case

**Since no compositional variation exists in the grains, hence, the boundary region is not defined in the grains.

[Preferred Embodiment 2]

Ti powder with a purity value above 99.7% and aiameter less than 45 μm, W powder with a purity value above 99% and diameter less than 1 μm, C powder with a purity value above 99% and diameter less than 5 μm, Ni powder with a purity value above 99.8% and diameter less than 6 μm, Co powder with diameter less than 10 μm are mixed to form a powder mixture of TiC 65 wt %, WC 20 wt %, Ni 8 wt % and Co 7 wt %.

The powder mixture is put into a tool steel milling jar together with tool steel balls with a diameter of 8 mm where the weight ratio between the powder mixture and balls is 23:1. Next, high energy ball milling is carried out for 5 hours using a planetary mill after the milling jar is charged with argon gas.

The surface temperature of the milling jar is measured using a non-contact type infrared thermometer.

The milled composite powder is dried, granulated and compacted under a pressure of 20 MPa. The compact is sintered under a $10^{-5}$ torr vacuum condition at temperature 1400° C. for a duration of 1 hour.

Figure 6:
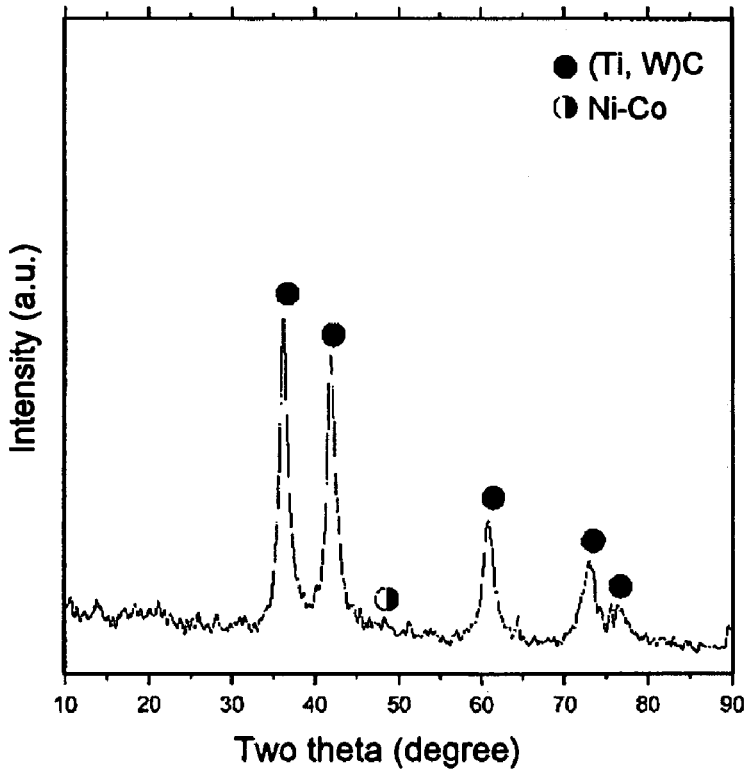
FIG. 6 represents the change in the X-ray diffraction pattern of TiC-20 wt %-WC-8 wt % Ni-7 wt % Co after 5 hours of high energy ball milling.
Figure 7:
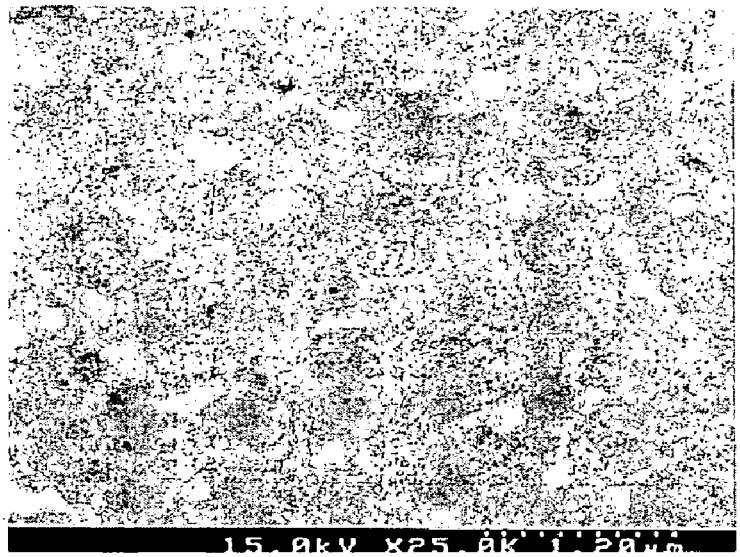
FIG. 7 shows a scanning electron microscope (SEM) picture of the microstructure of (Ti, W)C—(Ni, Co) type cermet fabricated according to the present invention.

FIG. 6 represents the change in the X-ray diffraction pattern after 5 hours of high energy ball milling.

The element powders of Ti, W, C, Ni and Co react to form a composite of (Ti,W)C and Ni in 5 hours of milling.

Ni and Co are determined to form a solid solution and the size of (Ti, W)C grain, which is deduced from the x-ray diffraction pattern, is estimated to about 10 nm.

FIG. 4 is a SEM picture which shows the microstructure of cermet obtained by sintering the manufactured powder.

The gray angular phase is (Ti, W)C grains and the bright phase is a Ni—Co matrix (Ni—Co solid solution) which is a liquid phase at the sintering temperature.

The cermet manufactured according to the method in the present invention does not show the core-rim structure and the size of carbide grains is very small. The average size of carbide grains measured by image analysis method is about 0.6 μm in diameter. This size is much smaller than that of the conventional cermet of which grain diameter is in a range between 2 and 5 μm.

The hardness of the cermet fabricated according to the method in the present invention is about 92HRA. The high hardness value is probably due to the fine grain structure of the cermet in the present invention.

According to the fabrication method of a sub-micron grain cermet alloy with a homogenous solid solution in the present invention, a sub-micron grain cermet alloy without the core-rim structure could be obtained by sintering the nano-composite powder of (Ti, TM)C—(Ni, Co) with diameter of about 10 nm obtained by high energy milling process. The fabrication method of the present invention allows the fabrication of a fine-grain structure cermet alloy through a relatively simple process and the fabricated cermet alloy exhibits a high hardness value which is not easily obtained using the conventional fabrication method.

What is claimed is:

1. A fabrication method of an ultra-fine TiC-base cermet alloy with a homogenous solid solution grain structure comprising the steps of:

forming powder mixture of TiC 50–90 wt % (weight percentage), TMxCy (where x and y are integers) 5–30 wt % and Ni or Co or a mixture of Ni and Co 5–30 wt % from mixing titanium (Ti) powder, transition metal (TM) powder, carbon (C) powder and nickel (Ni) powder or cobalt (Co) powder or both Ni powder and Co powder;

synthesizing a nano-composite powder of (Ti, TM)C—(Ni, Co) through a high energy ball-milling of previously said powder mixture by putting into a milling jar together with balls with a fixed diameter;

and compacting and sintering said synthesized composite powder.

2. The method as claimed in claim 1, wherein said Ti powder, transition metal powder, carbon powder, Ni powder and Co powder have a purity value above 95% and their diameter size is less than 1 mm.

3. The method as claimed in claim 1, wherein the basic material for said milling jar and the balls is at least one material selected from the group consisting of tool steel, stainless steel, WC—Co hard metal, silicon nitride, alumina, and Zirconia.

4. The method as claimed in claim 1, wherein said transition metal is at least one metal element selected from the group consisting of molybdenum (Mo), tungsten (W), niobium (Nb), vanadium (V) and chromium (Cr).

5. The method as claimed in claim 1, wherein the diameters of said balls are in a range between 5 and 30 mm and the weight ratio between the balls, which is put into the milling jar, and the powder mixture is in a range between 1:1 and 1:100.

6. The method as claimed in claim 1, further including a step of measuring the surface temperature of the milling jar using a non-contact type infrared thermometer during said high energy ball milling process.

7. The method as claimed in claim 1, further including a step of continuing said ball milling process for 1 to 20 hours if a sharp rise in temperature on the surface of the milling jar is detected.

8. The method as claimed in claim 1, wherein said high energy ball milling process is implemented using a shaker mill, vibration mill, planetary mill or attritor mill.

9. The method as claimed in claim 1, wherein said high energy ball-milling process is implemented after charging argon gas into the milling jar.

10. The method as claimed in claim 1, wherein said sintering is carried out under a $10^{-2}$ torr vacuum condition or under an argon environment in a temperature range between 1300 and 1500° C. for a duration of 1 to 4 hours.

11. The method as claimed in claim 6, wherein said high energy ball milling process is implemented using a shaker mill, vibration mill, planetary mill or attritor mill.

12. The method as claimed in claim 7, wherein said high energy ball milling process is implemented using a shaker mill, vibration mill, planetary mill or attritor mill.

13. The method as claimed in claim 6, wherein said high energy ball-milling process is implemented after charging argon gas into the milling jar.

14. The method as claimed in claim 7, wherein said high energy ball-milling process is implemented after charging argon gas into the milling jar.

* * * * *